US010319542B2

(12) United States Patent
Hertzog

(10) Patent No.: US 10,319,542 B2
(45) Date of Patent: Jun. 11, 2019

(54) ELECTRIC ARC-CONTROL DEVICE

(71) Applicant: SOCOMEC, Benfeld (FR)

(72) Inventor: Jérôme Hertzog, Benfeld (FR)

(73) Assignee: SOCOMEC, Benfeld (FR)

( * ) Notice: Subject to any disclaimer, the term of this patent is extended or adjusted under 35 U.S.C. 154(b) by 0 days.

(21) Appl. No.: 15/521,368

(22) PCT Filed: Oct. 20, 2015

(86) PCT No.: PCT/FR2015/052807

§ 371 (c)(1),
(2) Date: Apr. 24, 2017

(87) PCT Pub. No.: WO2016/062960

PCT Pub. Date: Apr. 28, 2016

(65) Prior Publication Data

US 2017/0309426 A1 Oct. 26, 2017

(30) Foreign Application Priority Data

Oct. 22, 2014 (FR) ..... 14 60150

(51) Int. Cl.
*H01H 9/34* (2006.01)
*H01H 9/46* (2006.01)
(Continued)

(52) U.S. Cl.
CPC ..... *H01H 33/20* (2013.01); *H01H 9/34* (2013.01); *H01H 9/46* (2013.01); *H01H 33/08* (2013.01); *H01H 73/18* (2013.01)

(58) Field of Classification Search
CPC ..... H01H 33/08; H01H 33/20; H01H 9/34; H01H 9/46; H01H 73/18; H01H 19/08; H01H 1/22; H01H 21/00; H01H 11/00
(Continued)

(56) References Cited

U.S. PATENT DOCUMENTS 4,011,420 A 3/1977 Heft
4,642,428 A 2/1987 Yoshiyasu et al.
(Continued)

FOREIGN PATENT DOCUMENTS

EP 0079978 A1 6/1983
JP S5087455 U 7/1975
WO WO20131864321 * 12/2013 ..... H01H 11/00

OTHER PUBLICATIONS

French Search Report for corresponding French Application No. FR1460150, dated Jul. 9, 2015.
(Continued)

*Primary Examiner* — Edwin A. Leon
*Assistant Examiner* — William A Bolton
(74) *Attorney, Agent, or Firm* — Workman Nydegger

(57) ABSTRACT

An electric arc breaker device comprises a contact zone in which there are present at least one stationary contact and at least one movable contact that is movable relative to the stationary contact. The contacts are capable of being put into contact with each other and of being separated from each other. An arcing horn is present facing the stationary contact, the height $h_c$ of the arcing horn being greater than or equal to the height $h_t$ of the stationary contact, and the arcing horn presenting a folded-back arc switching portion extending in a direction away from the stationary contact.

4 Claims, 5 Drawing Sheets

(51) Int. Cl.
*H01H 33/08* (2006.01)
*H01H 33/20* (2006.01)
*H01H 73/18* (2006.01)

(58) Field of Classification Search
USPC ..... 218/148, 149, 146, 36, 40, 158; 335/71, 335/133, 201, 202
See application file for complete search history.

(56) References Cited

U.S. PATENT DOCUMENTS 4,672,157 A 6/1987 Neel et al.
4,689,588 A * 8/1987 Murata ..... H01H 9/46 335/201
4,764,650 A * 8/1988 Bur ..... H01H 73/18 200/281
5,837,954 A 11/1998 Asakawa et al.
7,439,469 B2 * 10/2008 Gerving ..... H01H 9/36 218/38
7,875,822 B2 * 1/2011 Asokan ..... H01H 9/302 218/156
2005/0279734 A1 * 12/2005 Carothers ..... H01H 9/46 218/40
2013/0234812 A1 * 9/2013 Dahl ..... H01H 9/346 335/201
2014/0090969 A1 * 4/2014 Uitto ..... H01H 1/2041 200/571

OTHER PUBLICATIONS

International Search Report for corresponding International PCT Application No. PCT/FR2015052807, dated Jan. 11, 2016.
"Comments Regarding the Objections Raised in the Written Opinion of the ISA," PCT Application No. PCT/FR2015/052807, dated Oct. 20, 2015, pp. 1-2.

* cited by examiner

FIG.3
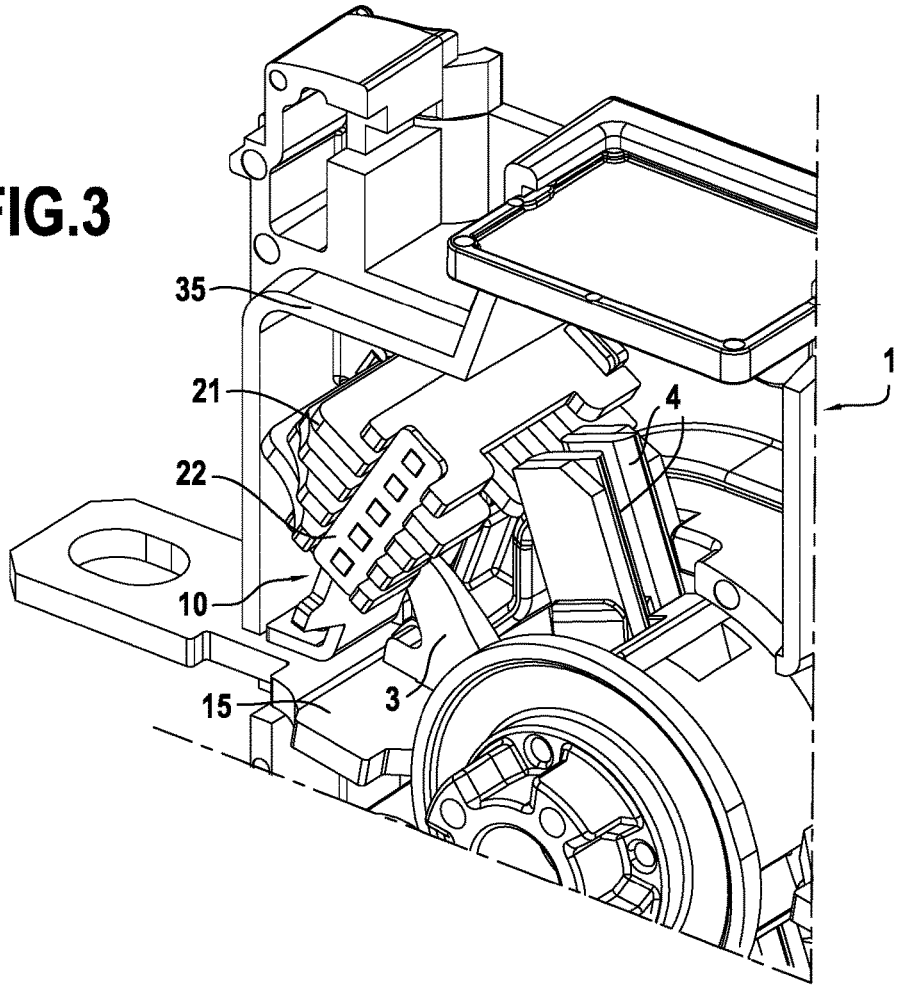
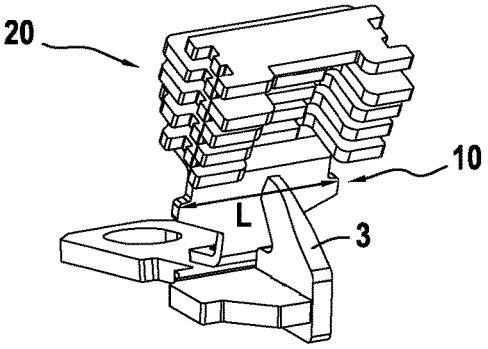
FIG.4

ELECTRIC ARC-CONTROL DEVICE

BACKGROUND OF THE INVENTION

The invention relates to the field of electric arc breaker devices.

When breaking a circuit, an electric arc is struck between electrical contacts. The arc creates a back electromotive force (emf) in the network that tends to oppose the source of the network. In an alternating current (AC) network, the magnitude of the current passing through the terminals of the breaker equipment passes periodically through zero. For example, these passages of the current through zero take place every 10 milliseconds (ms) in a 50 hertz (Hz) network. When the current passes through zero, the conductive arc cools down suddenly and the ions of the plasma of the arc then recombine. This recombination takes place more or less quickly depending on the extinction technique (splitting or lengthening), on the degree of pollution, and on the type of plasma. This recombination enables the break to withstand the network voltage that is still present at its terminals. If that is not so, then a electrical breakdown restarts the arc in the break, until the next time current passes through zero.

An arc voltage greater than the network voltage enables this dielectric recombination phenomenon to be started sooner than the natural passage of the current through zero, thereby increasing the chances of breaking the current.

Nevertheless, a problem arises for existing breaker devices resulting from the possible erosion of electrical contacts by the electric arcs that are generated. This erosion can affect the lifetime of such breaker devices.

There therefore exists a need to have novel breaker devices available with improved lifetime, in which the erosion of contacts due to the electric arc is limited.

OBJECT AND SUMMARY OF THE INVENTION

To this end, in a first aspect, the invention proposes an electric arc breaker device comprising:

a contact zone in which there are present at least one stationary contact and at least one movable contact that is movable relative to the stationary contact, the contacts being capable of being put into contact with each other and of being separated from each other; and an arcing horn present facing the stationary contact, the height of the arcing horn being greater than or equal to the height of the stationary contact, and the arcing horn presenting a folded-back arc switching portion extending in a direction away from the stationary contact.

Because of the presence of a folded-back switching portion, the arcing horn serves to push the arc back to the back of the breaker device, to improve splitting of the arc, and to move the arc away from the stationary contact. The movement of the arc from the stationary contact towards the arcing horn also serves to reduce erosion of the stationary contact because of limited contact between the electric arc and the stationary contact, thereby enabling the lifetime of the breaker device to be improved. The arc switching portion constitutes a sacrificial element that is consumed by the arc instead of consuming the stationary contact, thereby enabling the lifetime of the stationary contact to be improved and thus increasing the lifetime of the breaker device.

In an embodiment, the material forming the arc switching portion may have a change-of-state temperature that is higher than the change-of-state temperature of the material forming the stationary contact. This applies for example when the arcing horn is made of steel and the stationary contact is made of copper.

Thus, the material forming the arc switching portion may have a melting temperature or a vaporization temperature that is higher than the melting temperature, or respectively the vaporization temperature, of the material forming the stationary contact.

Using such an arcing horn is advantageous for reducing arc erosion both of the stationary contact and of the arcing horn since the arcing horn is made of a material that withstands arc erosion. Consequently, such a configuration makes it possible to further lengthen the lifetime of the breaker device.

In an embodiment, the breaker device may be present in a box, with the arcing horn having a width L equal to the inside width of said box.

Using such an arcing horn makes it possible to reduce, or even to avoid, the gas of the plasma passing laterally around it. As a result, this enables the path followed by the gas to be lengthened and thus enables the gas to be cooled better before being discharged to the outside of the breaker device. Such a configuration advantageously serves to minimize potential arcing outside the breaker device.

In an embodiment, the breaker device may also further include an extinction chamber containing a stack of electric arc splitting plates present facing the arcing horn.

Such a device serves to further improve the breaking capacity of the device and thus further limit erosion of the electrical contacts due to the arc.

In a variant, the breaker device need not have a stack of electric arc splitting plates.

Such a device advantageously makes it possible to have a solution for extinguishing an electric arc that is simple and inexpensive.

BRIEF DESCRIPTION OF THE DRAWINGS

Other characteristics and advantages of the invention appear from the following description of particular embodiments of the invention, given as non-limiting examples and with reference to the accompanying drawings, in which:

FIGS. 1 to 3 show a first example of a breaker device of the invention;

FIG. 4 shows a detail of the breaker device shown in FIGS. 1 to 3;

DETAILED DESCRIPTION OF EMBODIMENTS

Figure 1:
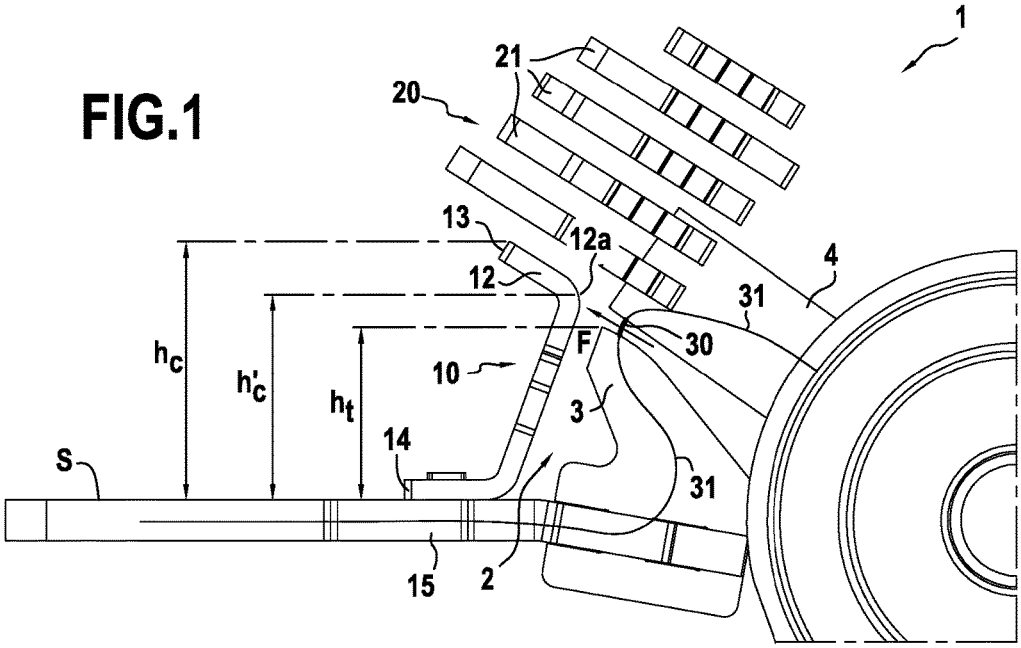

FIG. 1 shows an example of an electric arc breaker device 1 of the invention. The device shown serves to extinguish an electric arc in air. The breaker device 1 has a contact zone 2 in which there are present at least one stationary contact 3 and at least one movable contact 4 that is movable relative to the stationary contact 3. The contacts 3 and 4 can be put into contact with each other and they can be separated from each other, the movable contact 4 in the example shown being configured to perform a movement in rotation about a pivot axis when the contacts are separated. The contact head 3 and the stationary support 15 form a stationary subassembly enabling the breaker device 1 to be connected in an electrical installation. The contact head 3 may be made of metal material, e.g. of copper. When the movable contact 4 is in contact with the contact head 3, electricity can flow between these elements. When the movable contact 4 is separated from the contact head 3, electricity can no longer flow between these elements.

Figure 2:
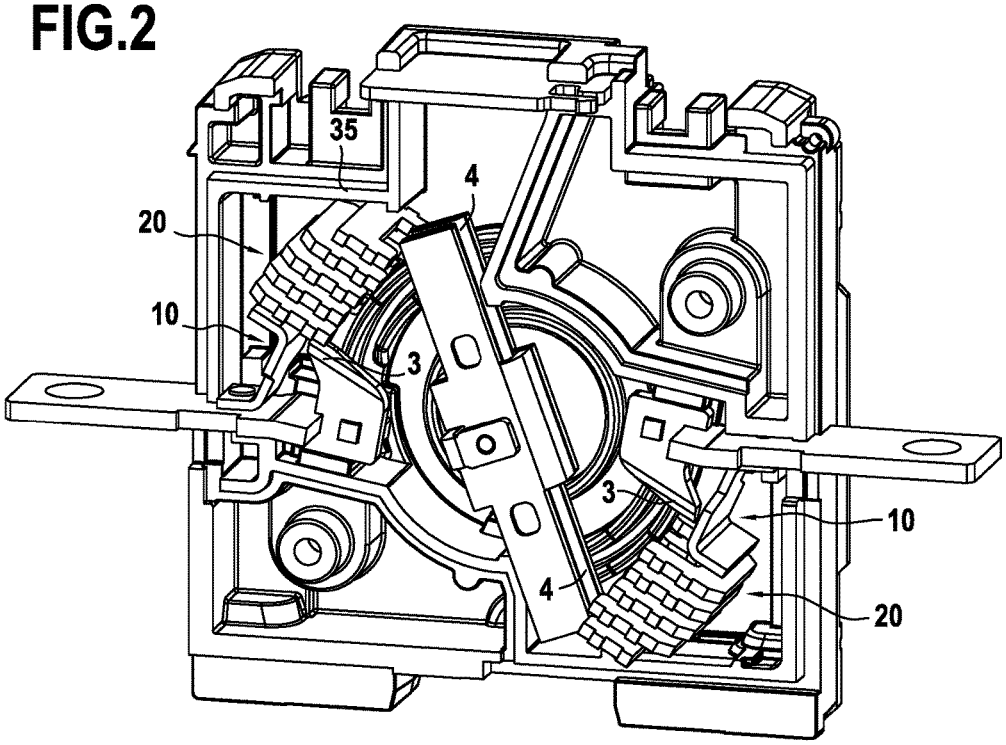

The breaker device shown is a double-break rotary breaker device having two blades and extinguishing two arcs (see FIG. 2). It would not go beyond the ambit of the invention for the breaker device to be of some other type, e.g. of the bladed single-break rotary type or of the double-break type with blades moving in translation.

In addition, the breaker device 1 includes an arcing horn 10 present facing the contact head 3 on the stationary support 15. The arcing horn 10 is fastened to the stationary support 15 by a mechanical connection. The arcing horn 10 has a tab 14 and an arc switching portion 12. The arcing horn is made of an electrically conductive material, for example the arcing horn 10 may be made out of a metal material, e.g. steel. In the example shown, the tab 14 is in contact with the stationary support 15, but it would not go beyond the ambit of the invention for the arcing horn 10 not to be in contact with the stationary support 15 but to be fastened to the box constituting the outer casing of the breaker device. Under such circumstances, the distance between the arcing horn 10 and the stationary support 15 may be less than or equal to 1 millimeter (mm) for example. An electric arc generated from the movable contact 4 is to be made to move over the arc switching portion 12, as described in detail below.

As shown, the height $h_c$ of the arcing horn 10 corresponding to the height at which the end 13 of the arc switching portion 12 is present, is greater than the height $h_t$ of the contact head 3. The arc switching portion 12 is folded back and extends in a direction opposite from the stationary contact 3 (i.e. it extends away from the stationary contact 3). As shown, the switching portion 12 forms a bend 12*a*. The height $h_c$ of the arcing horn 10 and the height $h'_c$ at which the bend 12*a* is present are both greater than the height $h_t$ of the contact head 3 in the example shown. The heights $h_c$, $h'_c$, and $h_t$ are measured from the surface S of the stationary support 15 facing the arcing horn 10, and perpendicularly to the surface S.

The breaker device 1 is present in a box 35. In the example shown, the box comprises the combination of two half-boxes (see FIGS. 2 and 3). Together with the other half-box (not shown), the half-box forms the outer casing of the breaker device. This casing enables the breaker device to be installed in an electrical installation. The arcing horn 10 is of a width equal to the inside width of the box 35 in order to reduce, or even prevent, the gas of the plasma passing laterally around said arcing horn 10. FIG. 4 shows the arcing horn and illustrates the fact that it is of sufficient width to limit the extent to which the gas can pass laterally around it. The width L of the arcing horn 10 corresponds to its greatest dimension measured perpendicularly to its height.

In addition, the breaker device 1 in the example shown in FIG. 1 includes an extinction chamber 20 having a stack of splitting plates 21. The electric arc splitting plates 21 are mounted on a plate support 22 (see FIG. 3). Mounting the splitting plates 21 on the plate support 22 makes it possible to form an extinction chamber 20 that is rigid. The splitting plates 21 are made of mild steel, for example. By way of example, the plate support 22 may be made of vulcanized card. In a variant, the splitting plates may be mounted directly on the box constituting the outer casing of the breaker device. The extinction chamber 20 shown has a plurality of stacked splitting plates 21, e.g. at least three stacked splitting plates 21, e.g. at least five stacked splitting plates 21. By way of example, the splitting plates may be V-shaped or U-shaped when observed in a direction perpendicular to the plane in which they extend.

As shown in FIG. 1 in particular, an electric arc 30 is formed after the contacts 3 and 4 have separated. The arc 30 is struck at the location of the last electrical contact. The arc 30 is subjected to the Laplace (or Lorentz) force induced by the flow of electric current, with this flow being represented by curves 31. The arc 30 is in a current loop and the Laplace forces acting on the loop tend to open it. This effect is commonly referred to as the loop effect. The Laplace force acting on the arc 30 tends to push the arc 30 towards the back of the breaker device 1.

There follows a description of the behavior of the arc 30 generated between the contacts 3 and 4.

Figure 5:
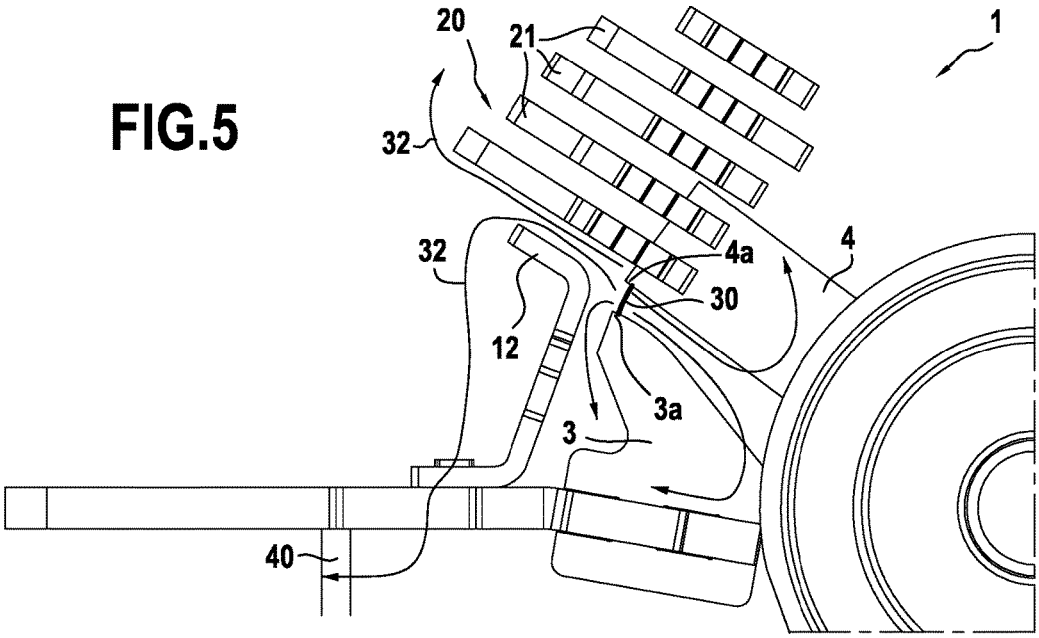
FIGS. 5 to 8 show how an electric arc behaves in the breaker device of FIGS. 1 to 3.

The contacts continue their separation movement. The arc 30 then moves to the end 3*a* of the contact head 3 and to the end 4*a* of the movable contact 4 (see FIG. 5). The plasma coming from the cooled arc can follow a predetermined path represented by arrows 32. Because an arcing horn 10 of sufficient width is used, the gas follows a longer path and is thus better cooled prior to being discharged to the outside of the breaker device. This may advantageously serve to minimize potential arcing outside the breaker device. The majority of the volume of this plasma gas is deflected towards an exhaust orifice 40 and flows in the volume defined by the switching portion 12 and the splitting plates closest thereto. This gas enables the medium close to the arcing horn to be in better electric breakdown conditions (dielectric strength decreases with increasing temperature).

Figure 6:
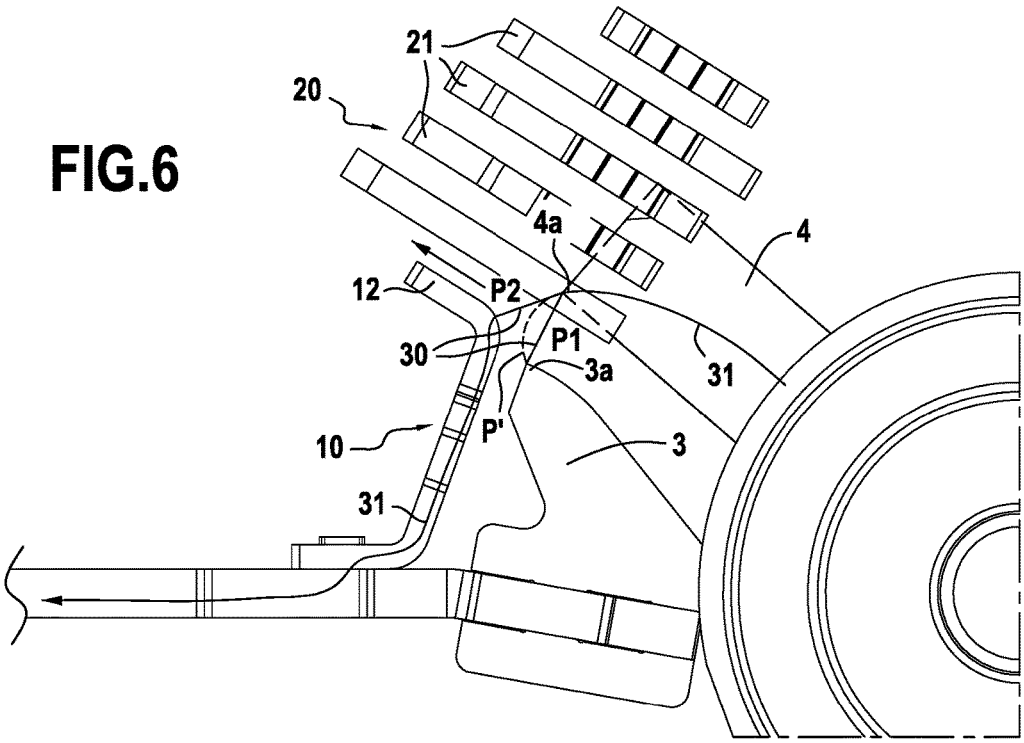

The contacts continue their separation movement. The arc at the end of the contact head (configuration P1 shown diagrammatically in FIG. 6) then switches onto the switching portion 12 of the arcing horn 10 (configuration P2) since its length becomes shorter after switching. Such switching can be explained by the fact that it is preferable for the electric arc to extend along a path having as little "impedance" as possible, corresponding in this example to a path having the shortest possible length. This switching results from an electric breakdown phenomenon. Furthermore, the arc in the configuration P1 is also subjected to the loop effect resulting from the flow of current, which tends to deform it and to give it a curved shape (see dashed-line configuration P' in FIG. 6). This deformation serves to further facilitate switching the arc onto the arcing horn. In the example shown, in which the movable contact 4 rotates during separation of the contacts, the arc moves radially when switching onto the arcing horn, i.e. perpendicularly to the axis of rotation of the movable contact.

After switching, the root of the arc beside the arcing horn is subjected to a Laplace force (arrow shown in FIG. 6) due to the loop effect (current flow 31), which pushes it towards the back of the breaker device. In so doing, because of its very high temperature, the root of the arc erodes the switching portion 12. Thus, the switching portion 12 constitutes a sacrificial portion of the breaker device that is consumed instead of the stationary contact 3. This makes it possible to lengthen the time during which the contacts of the breaker device can be used, thereby improving the lifetime of the breaker device.

Figure 7:
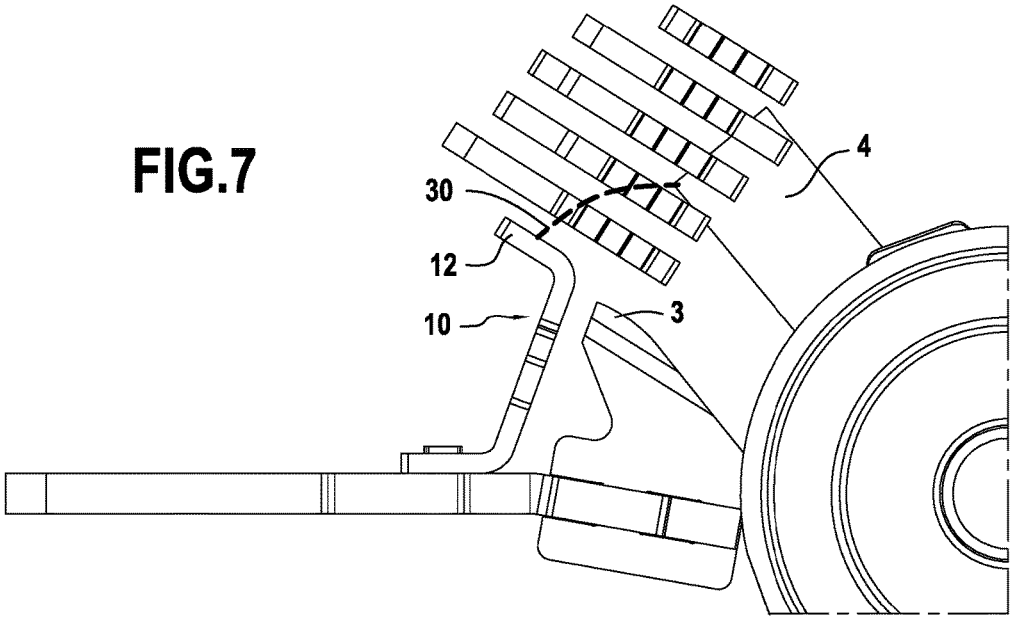
Figure 8:
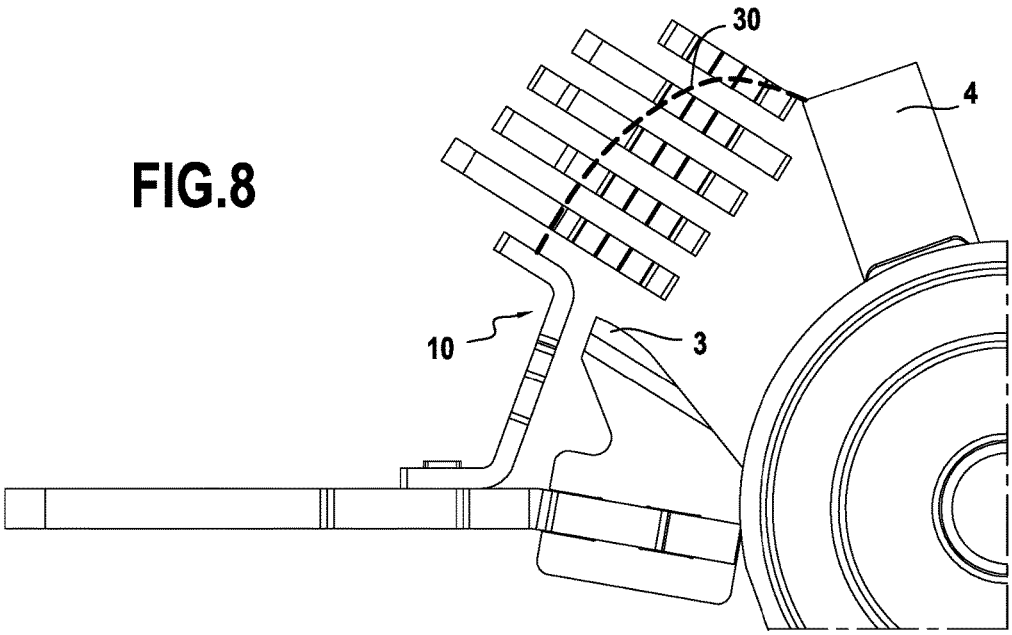

The contacts still continue their separation movement. The arc penetrates into the extinction chamber and is split. As a result, it maintains a certain fixed voltage level (cathode voltage drops and anode voltage drops at the various arc roots) and it cools (exchanges between the arc and the splitting plates serving to increase impedance). After the contacts are completely separated, the arc is totally split in the extinction chamber (see FIGS. 7 and 8).

Figure 9:
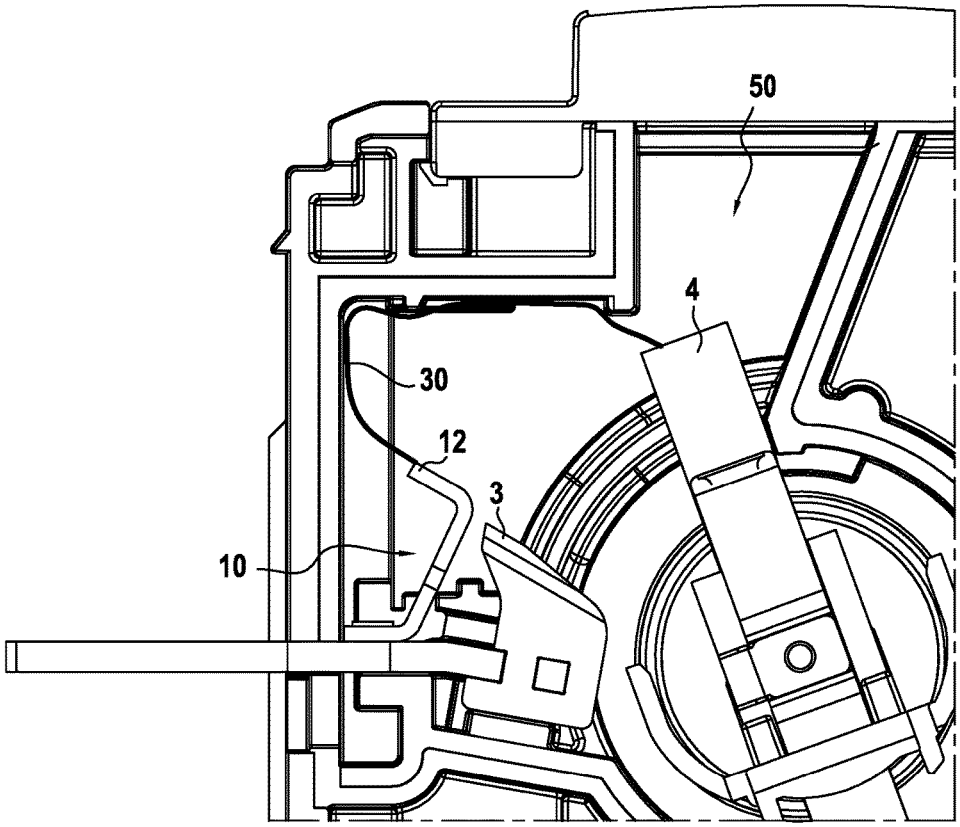
FIG. 9 shows a variant of the breaker device of the invention.

This extinction principle can also apply without splitting plates, thus making it possible to provide a simplified breaker device 50, as shown in FIG. 9. The switching of the arc from the contact head 3 onto the arcing horn 10 takes place as with the extinction chamber. After switching, the arc no longer stabilizes in the extinction chamber, but lengthens to the back of the breaker device 50. This lengthening results from the Laplace forces that are the consequence of the loop effect. The lengthening enables the arc to increase its impedance. The arc lengthens along the inside wall of the box, thereby tending to cool the arc and also to increase its impedance. The arc root becomes stabilized at the end of the switching portion 12, with this zone being a sacrificial zone, as described above.

The breaker device of the invention can be used for breaking direct current (DC), or alternating current (AC). Breaker devices of the invention can be used in the low voltage range (U_AC≤1000 volts (V) and U_DC≤1500 V).

The term "including/containing/comprising a" should be understood as "including/containing/comprising at least one".

The term "in the range . . . to . . . " should be understood as including the bounds.

The invention claimed is:

1. An electric arc breaker device comprising:

a contact zone in which there are present at least one stationary contact and at least one movable contact that is movable relative to the stationary contact, the contacts being capable of being put into contact with each other and of being separated from each other; and an arcing horn present facing the stationary contact, a height $h_c$ of the arcing horn being greater than or equal to a height $h_t$ of the stationary contact, and the arcing horn presenting a folded-back arc switching portion extending in a direction away from the stationary contact;

the device being present in a box and the arcing horn having a width L equal to an inside width of said box, wherein the arcing horn comprises a first portion facing the stationary contact extending from a first end located beside a stationary support to a second end forming a bend of the arcing horn, said bend being present at a height greater than the height $h_t$, of the stationary contact, and wherein the arcing horn further comprises a second portion forming the folded-back arc switching portion which extends from the second end and which is superposed to a material of the first portion, and wherein a width of the first portion varies to reach a maximum value between the first end and the second end.

2. The device according to claim 1, wherein it further includes an extinction chamber containing a stack of electric arc splitting plates present facing the arcing horn.

3. The device according to claim 1, wherein it does not include a stack of electric arc splitting plates.

4. The device according to claim 1, wherein a material forming the arc switching portion has a change-of-state temperature that is higher than the change-of-state temperature of a material forming the stationary contact.

* * * * *